US010851749B2

(12) United States Patent
Lucarelli et al.

(10) Patent No.: US 10,851,749 B2
(45) Date of Patent: Dec. 1, 2020

(54) HIGH-PRESSURE PUMP

(71) Applicant: Robert Bosch GmbH, Stuttgart (DE)

(72) Inventors: Francesco Lucarelli, Stuttgart (DE); Dietmar Van Der Linden, Rietenau (DE); Karl-Heinz Laepple, Althengstett (DE)

(73) Assignee: Robert Bosch GmbH, Stuttgart (DE)

( * ) Notice: Subject to any disclaimer, the term of this patent is extended or adjusted under 35 U.S.C. 154(b) by 170 days.

(21) Appl. No.: 15/770,295

(22) PCT Filed: Sep. 13, 2016

(86) PCT No.: PCT/EP2016/071565
§ 371 (c)(1),
(2) Date: Sep. 4, 2018

(87) PCT Pub. No.: WO2017/071867
PCT Pub. Date: May 4, 2017

(65) Prior Publication Data

US 2018/0363609 A1 Dec. 20, 2018

(30) Foreign Application Priority Data

Oct. 26, 2015 (DE) ..... 10 2015 220 870

(51) Int. Cl.
*F02M 59/10* (2006.01)
*F02M 59/06* (2006.01)
(Continued)

(52) U.S. Cl.
CPC ..... *F02M 59/102* (2013.01); *F02M 59/06* (2013.01); *F02M 59/44* (2013.01); *F02M 59/48* (2013.01); *F02M 63/0265* (2013.01)

(58) Field of Classification Search
CPC ..... F02M 59/102; F02M 59/48; F02M 59/06; F02M 59/44; F02M 63/0265; F04B 1/0439
See application file for complete search history.

(56) References Cited

U.S. PATENT DOCUMENTS 9,885,329 B2 * 2/2018 Vu ..... F16H 53/06
2010/0037865 A1 * 2/2010 Fuchs ..... F04B 1/0439 123/508
(Continued)

FOREIGN PATENT DOCUMENTS

CN 103958880 A 7/2014
CN 104285061 A 1/2015
(Continued)

OTHER PUBLICATIONS

International Search Report for Application No. PCT/EP2016/071565 dated Nov. 18, 2016 (English Translation, 2 pages).

*Primary Examiner* — George C Jin
(74) *Attorney, Agent, or Firm* — Michael Best & Friedrich LLP

(57) ABSTRACT

The invention relates to a high-pressure pump (1), in particular for a motor vehicle, for conveying a fluid, in particular fuel, e.g. diesel fuel, comprising a drive shaft having at least one cam, at least one piston, at least one cylinder (6) for mounting the at least one cam, wherein the at least one piston is supported on the drive shaft by the at least one cam, so that a translational motion can be carried out by the at least one cam as a result of a rotary motion of the drive shaft, at least one cover cap (8), which is attached indirectly or directly to the outside of the cylinder (6), wherein one end (18) of the at least one cover cap (8) rests on a projection (16) of the remaining high-pressure pump (1) for the interlocking attachment of the end (18) of the cover cap (8) to the projection (16).

20 Claims, 6 Drawing Sheets

(51) Int. Cl.

| | |
|---|---|
| ***F02M 59/48*** | (2006.01) |
| ***F02M 59/44*** | (2006.01) |
| ***F02M 63/02*** | (2006.01) |

(56) References Cited

U.S. PATENT DOCUMENTS

| | | | | |
|---|---|---|---|---|
| 2016/0169173 | A1* | 6/2016 | Yabuuchi | F02M 59/44<br>417/274 |
| 2018/0306151 | A1* | 10/2018 | Laepple | F02M 59/44 |

FOREIGN PATENT DOCUMENTS

| | | |
|---|---|---|
| DE | 10345725 | 4/2005 |
| DE | 10356262 | 6/2005 |
| DE | 102006045933 | 4/2008 |
| DE | 102013206930 | 10/2014 |
| WO | 2015010856 | 1/2015 |

* cited by examiner (A-A)

HIGH-PRESSURE PUMP

BACKGROUND OF THE INVENTION

The present invention relates to a high pressure, to a method for producing a high pressure pump, and to a high pressure injection system.

In high pressure injection systems for internal combustion engines, in particular in common rail injection systems of diesel or gasoline engines, a high pressure pump continuously ensures the maintenance of the pressure in the high pressure accumulator of the common rail injection system. The high pressure pump can be driven, for example, by way of a camshaft of the internal combustion engine by means of a drive shaft. Prefeed pumps, for example a gear pump or a sliding vane rotary pump, which are connected upstream of the high pressure pump are used for the delivery of the fuel to the high pressure pump. The prefeed pump delivers the fuel from a fuel tank through a fuel line to the high pressure pump.

Piston pumps, inter alia, are used as high pressure pumps. A drive shaft is mounted in a housing. Pistons are arranged in a cylinder radially with respect thereto. A cam roller with a roller rolling face which is mounted in a roller shoe lies on the drive shaft with at least one cam. The roller shoe is connected to the piston, with the result that the piston is forced to carry out an oscillating translational movement. A spring applies a force, which is directed radially with respect to the drive shaft, to the roller shoe, with the result that the cam roller is in constant contact with the drive shaft. The cam roller is in contact with the drive shaft by way of the roller rolling face on a shaft rolling face as a surface of the drive shaft with the at least one cam. The cam roller is mounted in the roller shoe by means of a plain bearing.

The cylinder, in particular the cylinder head, of the high pressure pump is covered by a covering cap made from a hard plastic, in particular a reinforced polyamide. The object of the covering cap consists in visually concealing possible corrosion on the cylinder head, with the result that the corrosion is no longer visible. On account of the hard material properties of the covering cap, the covering cap cannot be adapted substantially to different geometries of the high pressure pump during fastening and pushing onto the high pressure pump. During the assembly, the covering cap is generally fastened before the fastening of an electric plug, since fastening of the covering cap is not possible after the fastening of the electric plug to the high pressure pump on account of the merely very low or impossible deformation of the electric plug and the remaining high pressure pump. As a result, the assembly of the high pressure pump is made unnecessarily difficult.

DE 10 2006 045 933 A1 discloses a high pressure pump for high pressure fuel delivery. The high pressure pump has a drive shaft with cams. Cylindrical rollers are mounted by roller shoes and lie on the cams. The roller shoes are mounted in a bore of a part of the housing by means of a tappet assembly. The pump elements are fastened to the tappet assembly. A helical spring presses the tappet assembly onto the cams.

DE 103 56 262 A1 has disclosed a radial piston pump for high pressure fuel generation in fuel injection systems of internal combustion engines. A drive shaft is mounted in a pump housing. Pistons are supported on the drive shaft, with the result that the pistons are moved to and fro by way of rotation of the drive shaft. Tappets are arranged between the pistons and the drive shaft.

SUMMARY OF THE INVENTION

A high pressure pump according to the invention, in particular for a motor vehicle, for delivering a fluid, in particular fuel, for example diesel, comprising a drive shaft with at least one cam, at least one piston, at least one cylinder for mounting the at least one piston, the at least one piston being supported on the drive shaft with the at least one cam, with the result that a translational movement can be carried out by the at least one piston on the basis of a rotational movement of the drive shaft, at least one covering cap which is fastened indirectly or directly to the cylinder on the outer side, an end of the at least one covering cap lying on a projection of the remaining high pressure pump for fastening the end of the covering cap to the projection in a positively locking manner. An end, in particular an axial end, of the at least one covering cap lies on the projection, with the result that the covering cap is fastened particularly simply to the remaining high pressure pump in a positively locking manner as a result. This firstly makes simple assembly of the covering cap possible, and secondly the covering cap is fastened particularly reliably and permanently to the remaining high pressure pump as a result.

In an additional embodiment, the projection is configured on the high pressure pump on the outer side and/or the projection is configured as an undercut and/or the projection is configured in the radial direction with regard to a longitudinal axis of the cylinder, and the end of the at least one covering cap lies on an axial stop of the projection.

In a supplementary variant, the projection is configured in the circumferential direction or tangential direction with regard to a longitudinal axis of the cylinder and/or the projection is formed by a ring or a nut, in particular a union nut, on the cylinder. At an axial end, the union nut or the ring forms the projection and also the axial stop. Particularly secure and reliable fastening is possible as a result, since the projection and/or the axial stop are/is configured in a completely circumferential manner in the tangential direction with regard to the longitudinal axis. As a result, a completely circumferential end, as an edge of an opening on the covering cap, can also be placed and fastened completely circumferentially onto the axial stop in a positively locking manner.

In an additional embodiment, the at least one covering cap has a substantially central opening. The opening serves to lead through an electric plug. Control lines are arranged in the electric plug for controlling and/or regulating a metering unit of the high pressure pump. The metering unit is preferably integrated into the high pressure pump, in particular a cylinder and/or a housing of the high pressure pump.

In an additional embodiment, the at least one covering cap has a substantially radially configured supporting section and a substantially axially configured supporting section. The radial supporting section is configured substantially in the radial direction with regard to the longitudinal axis of the cylinder, and the axial supporting section is configured substantially in the axial direction with regard to the longitudinal axis of the cylinder.

The opening is preferably configured on the radial supporting section.

In an additional refinement, that end of the at least one covering cap which lies on the projection of the remaining high pressure pump is an edge of the opening.

In a supplementary variant, an electric plug is arranged in the opening.

In an additional embodiment, a cutout for a fuel nozzle is configured on the at least one covering cap, in particular on the axial supporting section, and/or the cylinder comprises a cylinder head and/or a mounting cylinder. The cylinder head delimits an operating space of the high pressure pump, and the mounting cylinder serves to mount the at least one piston.

In a supplementary refinement, the at least one covering cap lies on the remaining high pressure pump with an elastic prestressing force and/or the at least one covering cap is configured at least partially, in particular completely, from an elastic plastic, preferably a thermoplastic elastomer, and/or the at least one covering cap is configured at least partially, in particular completely, from a material with a modulus of elasticity of less than 5, 1 or 0.2 $kN/mm^2$. On account of the elastic prestressing force, the covering cap is additionally fastened to the remaining high pressure pump in a non-positive manner. On account of the elastic properties of the covering cap, elastic stretching of the covering cap can be carried out during the assembly, which elastic stretching is still at least partially present after the fastening, with the result that the covering cap lies on the remaining high pressure pump on the outer side with an elastic prestressing force on account of said elastic prestressing of the covering cap. In addition to the positively locking fastening of the covering cap to the remaining high pressure pump, the covering cap can therefore additionally also be fastened to the remaining high pressure pump in a non-positive manner.

A method according to the invention for producing a high pressure pump, in particular a high pressure pump which is described in this intellectual property right application, having the steps: provision of a drive shaft with at least one cam, provision of at least one piston, provision of at least one cylinder for mounting the at least one piston, provision of at least one covering cap, mounting of the at least one drive shaft, of the at least one piston, and of the at least one cylinder, with the result that the at least one piston is supported on the drive shaft with the at least one cam, and a translational movement can be carried out by the at least one piston on the basis of a rotational movement of the drive shaft, fastening of the at least one covering cap indirectly or directly on the cylinder on the outer side, the covering cap first of all being stretched elastically for fastening purposes, and an elastic recovery subsequently being carried out, with the result that an end of the at least one covering cap lies on the projection of the remaining high pressure pump on account of the elastic recovery, and the at least one covering cap is fastened to the projection in a positively locking manner as a result.

In a supplementary refinement, an electric plug is first of all mounted, and the at least one covering cap is subsequently fastened and/or the at least one covering cap is stretched in the radial direction with regard to the longitudinal axis of the cylinder and is recovered elastically.

The at least one covering cap is expediently stretched substantially at an edge of an opening as the end of the at least one covering cap, with the result that the size of the opening is increased by way of the stretching, and the elastic recovery is subsequently carried out substantially at the edge of the opening and/or the electric plug which has already been mounted is first of all guided through the opening of the at least one covering cap, and the elastic stretching of the at least one covering cap is subsequently carried out and/or the covering cap, in particular an axial supporting section, is stretched, in particular is stretched in the radial direction, and the covering cap, in particular the axial supporting section, is subsequently fastened on the remaining high pressure pump with an elastic prestress.

In an additional variant, the at least one covering cap is stretched, by the covering cap being pushed onto the high pressure pump on the outer side in the axial direction, and the axial movement of the at least one covering cap bringing about the (in particular, radial) stretching of the at least one covering cap on account of the outer-side geometry of the high pressure pump.

In a supplementary refinement, the at least one piston is supported indirectly by way of a cam roller or another supporting apparatus on the drive shaft with the at least one cam.

The at least one cam roller is expediently mounted by means of at least one plain bearing or a plain bearing system in at least one roller shoe.

In a further embodiment, the at least one cam roller engages around the plain bearing by more than 50% of the at least one cam roller in a section perpendicularly with respect to a longitudinal axis as rotational axis.

In particular, the plain bearing is lubricated by means of fuel, for example gasoline or diesel.

In a further refinement, a contact face between the roller rolling face and the shaft rolling face is lubricated by means of fuel.

In a further variant, an eccentric shaft is considered to be a drive shaft with at least one cam.

In a supplementary refinement, a radial direction and/or axial direction relate/relates to a longitudinal axis of the cylinder, on which the covering cap lies indirectly or directly.

A high pressure injection system according to the invention for an internal combustion engine, in particular for a motor vehicle, comprising a high pressure pump, a high pressure rail, preferably a prefeed pump for delivering a fuel from a fuel tank to the high pressure pump, the high pressure pump being configured as a high pressure pump which is described in this intellectual property right application.

In a further variant, the high pressure injection system has a metering unit which controls or regulates the quantity of fuel which is delivered by the prefeed pump to the high pressure pump per unit time.

The pressure in the high pressure rail which can be generated by the high pressure pump lies, for example, in the range of from 1000 to 3000 bar, for example for diesel engines, or between 40 bar and 400 bar, for example for gasoline engines.

An internal combustion engine according to the invention having a high pressure injection system, in particular for a motor vehicle, comprises a high pressure injection system which is described in this intellectual property right application and/or a high pressure pump which is described in this intellectual property right application.

BRIEF DESCRIPTION OF THE DRAWINGS

In the following text, exemplary embodiments of the invention will be described in greater detail with reference to the appended drawings, in which.

DETAILED DESCRIPTION

Figure 1:
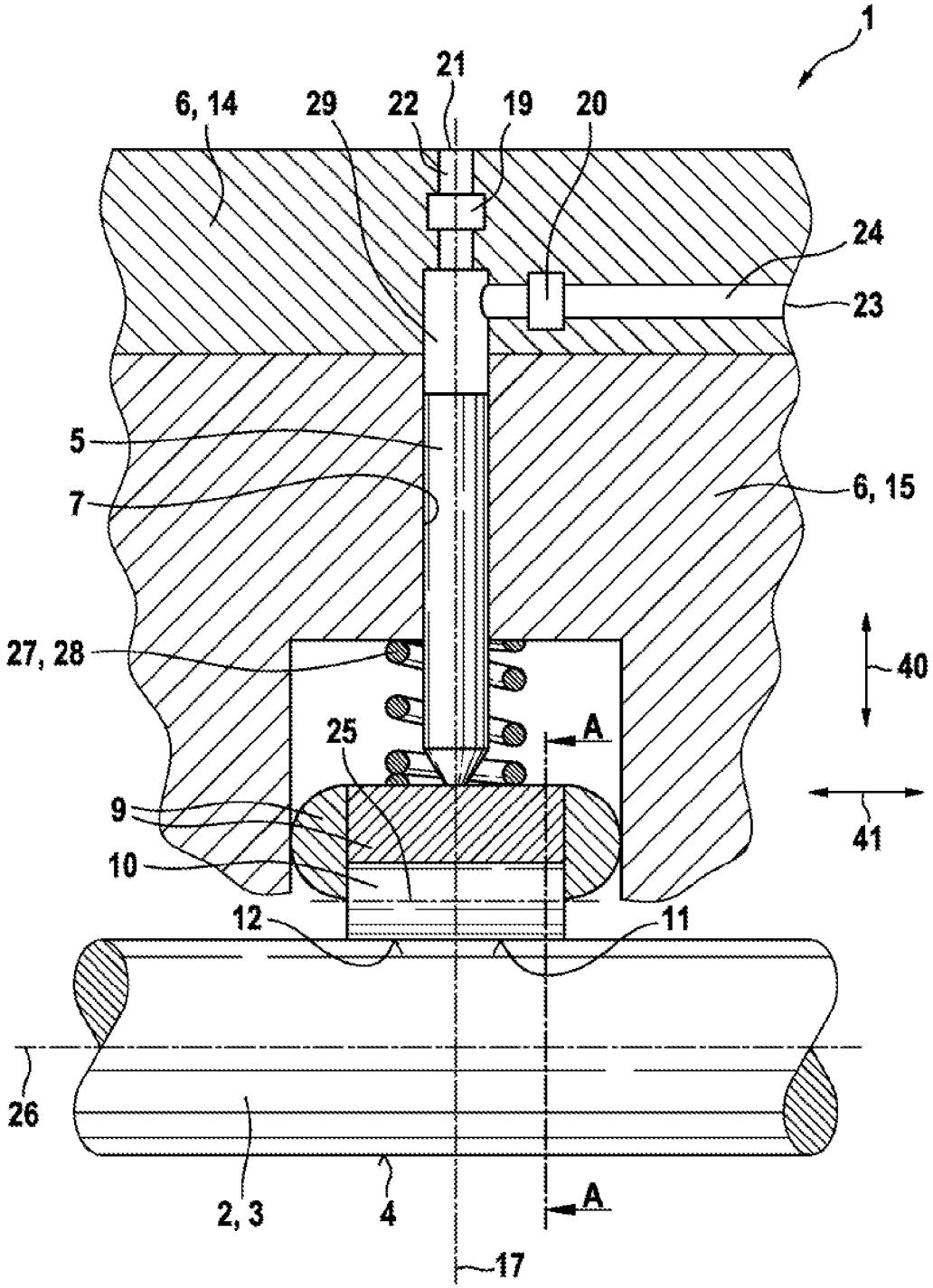
FIG. 1 shows a cross section of a high pressure pump.

FIG. 1 shows a greatly simplified cross section of a high pressure pump 1 for a high pressure injection system 36. FIG. 1 serves only to illustrate the operating principle and does not show, in particular, the exact geometrical configuration of a cylinder 6. The cylinder 6 comprises a cylinder head 14 and a mounting cylinder 15. The high pressure pump 1 serves to deliver fuel, for example gasoline or diesel, to an internal combustion engine 39 under high pressure. The pressure which can be generated by the high pressure pump 1 lies, for example, in a range of between 1000 and 3000 bar.

Figure 2:
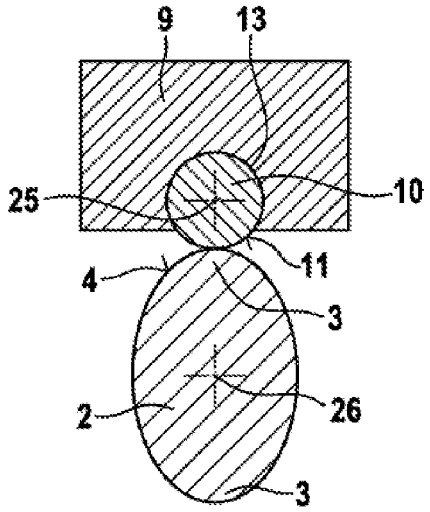
FIG. 2 shows a section A-A in accordance with FIG. 1 of a cam roller with a roller shoe and a drive shaft.

The high pressure pump 1 has a drive shaft 2 with two cams 3, which drive shaft 2 carries out a rotational movement about a rotational axis 26. The rotational axis 26 lies in the plane of the drawing of FIG. 1 and lies perpendicularly on the plane of the drawing of FIG. 2. A piston 5 is mounted in a piston guide 7 of the mounting cylinder 15. The cylinder 6 therefore also forms a housing. A working space 29 is delimited by the cylinder 6, in particular the cylinder head 14, and the piston 5. An inlet duct 22 with an inlet valve 19 and an outlet duct 24 with an outlet valve 20 open into the working space 29. The fuel flows through the inlet duct 22 into the working space 29, and the fuel flows at high pressure out of the working space 29 again through the outlet duct 24. The inlet valve 19 (for example, a check valve) is configured in such a way that only fuel can flow into the working space 29, and the outlet valve 20 (for example, a check valve) is configured in such a way that only fuel can flow out of the working space 29. The volume of the working space 29 is changed on the basis of an oscillating stroke movement of the piston 5. The piston 5 is supported indirectly on the drive shaft 2. A roller shoe 9 with a cam roller 10 is fastened to the end of the piston 5 or pump piston 5. Here, the cam roller 10 can carry out a rotational movement, the rotational axis 25 of which lies in the plane of the drawing in accordance with FIG. 1 and lies perpendicularly on the plane of the drawing of FIG. 2. The drive shaft 2 with the at least one cam 3 has a shaft rolling face 4, and the cam roller 10 has a roller rolling face 11.

The roller rolling face 11 of the cam roller 10 rolls on the shaft rolling face 4 of the drive shaft 2 with the two cams 3. The roller shoe 9 is mounted as a plain bearing in a roller shoe bearing system which is formed by the cylinder 6. A spring 27 or spiral spring 27 as an elastic element 28 which is clamped in between the cylinder 6 and the roller shoe 9 applies a pressure force to the roller shoe 9, with the result that the roller rolling face 11 of the cam roller 10 is in constant contact with the shaft rolling face 4 of the drive shaft 2. The roller shoe 9 and the piston 5 therefore jointly carry out an oscillating stroke movement. Substantially no slip occurs on a contact face 12 between the shaft rolling face 4 of the drive shaft 2 and the roller rolling face 11 of the cam roller 10.

Figure 6:
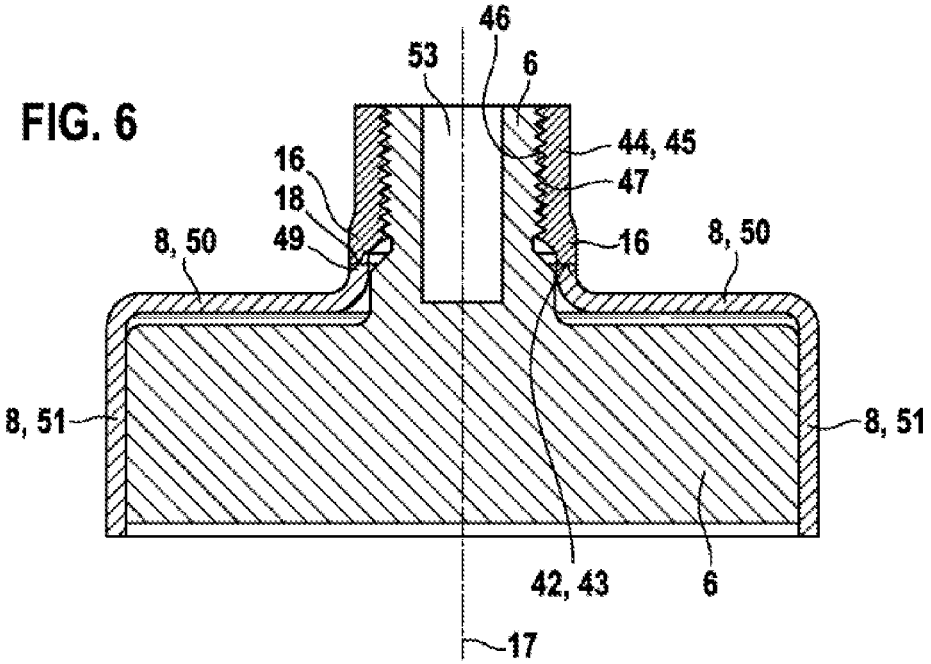
FIG. 6 shows a longitudinal section through the covering cap in accordance with FIG. 5, a part of the cylinder and a union nut after the fastening of the covering cap to the cylinder.

An elastic covering cap 8 made from an elastic plastic serves to conceal corrosion on the cylinder 6, in particular the cylinder head 14, with the result that corrosion which possibly occurs is not visible from the outside. The covering cap 8 has a radial supporting section 50 and an axial supporting section 51. The axial supporting section 51 is of substantially cylindrical or cylinder shell-shaped configuration and, moreover, has a cutout 55 for a fuel nozzle 54 of the high pressure pump 1. The inlet duct 22 and/or the outlet duct 24 are/is integrated into or installed in the fuel nozzle 54. An opening 48 for receiving an electric plug 52 is configured on the disk-shaped radial supporting section 50. The cylinder 6 has a longitudinal axis 17, and the longitudinal axis 17 also corresponds to a movement direction of the translational movement of the piston 5. An axial direction 40 is oriented parallel to the longitudinal axis 17, and a radial direction 41 lies perpendicularly on the longitudinal axis 17 of the cylinder 6. FIG. 6 shows the cylinder 6 in a very greatly simplified manner without a distinction in terms of the cylinder head 14 and the mounting cylinder 15. A bore 53 for receiving the electric plug 52 is machined into the cylinder 6. Moreover, an end region of the cylinder 6 has an external thread 47, and a union nut 45 with an internal thread 46 is screwed onto the external thread 47. The union nut 45 also forms a ring 44. The lower end region (shown in FIG. 6) of the union nut 45 has a greater radial spacing from the longitudinal axis 17 than the cylinder 6 in this region, with the result that a lower axial end (shown in FIG. 6) of the union nut 45 forms an axial stop 43 for the covering cap 8 as a result. The axial stop 43 or the lower end region of the union nut 45 in accordance with the illustration in FIG. 6 therefore forms a projection 16 with regard to the cylinder 6 and also an undercut 42 which is completely circumferential in the circumferential direction.

Figure 7:
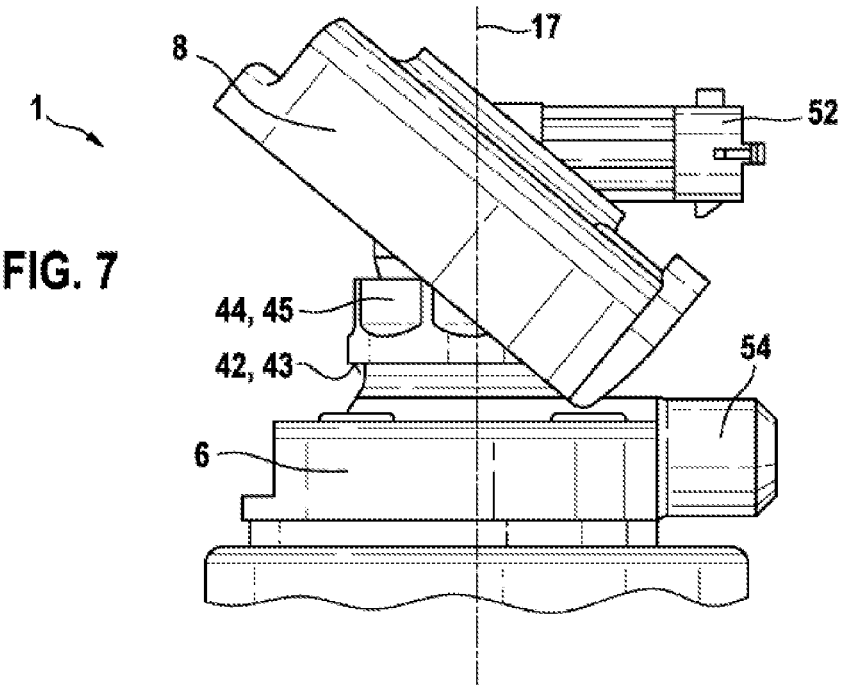
FIG. 7 shows a first perspective view of a part of the high pressure pump during the fastening of the covering cap in accordance with FIG. 5 to the cylinder.
Figure 8:
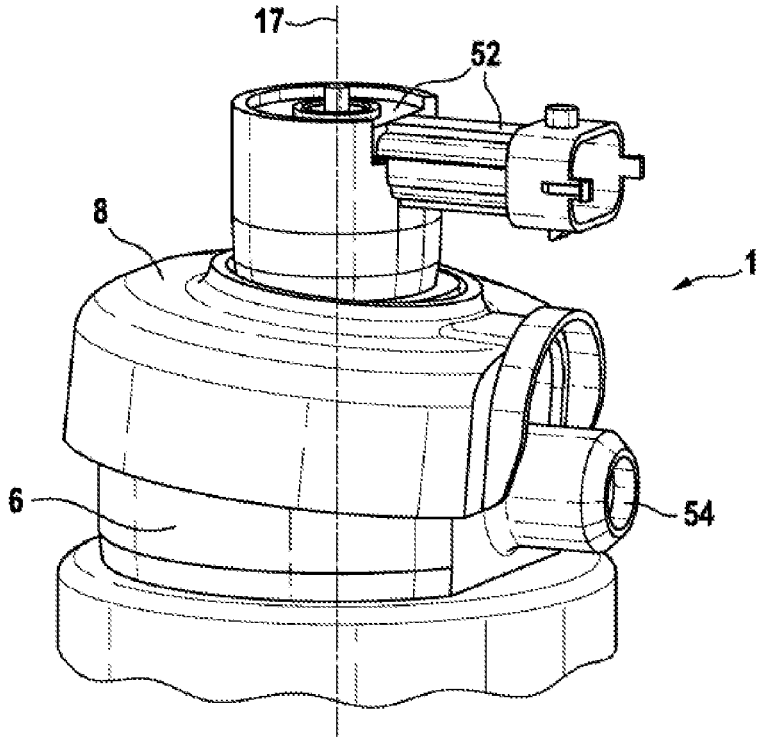
FIG. 8 shows a second perspective view of a part of the high pressure pump during the fastening of the covering cap in accordance with FIG. 5 to the cylinder.
Figure 9:
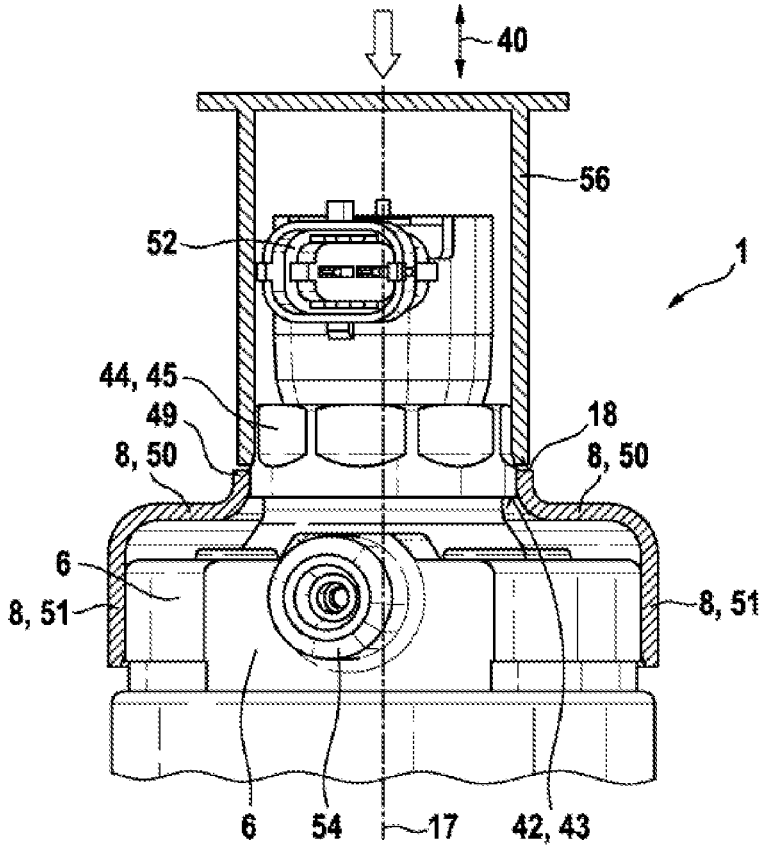
FIG. 9 shows a first side view of a part of the high pressure pump shortly before the fastening of the covering cap in accordance with FIG. 5 to the cylinder, and a longitudinal section of the covering cap.
Figure 10:
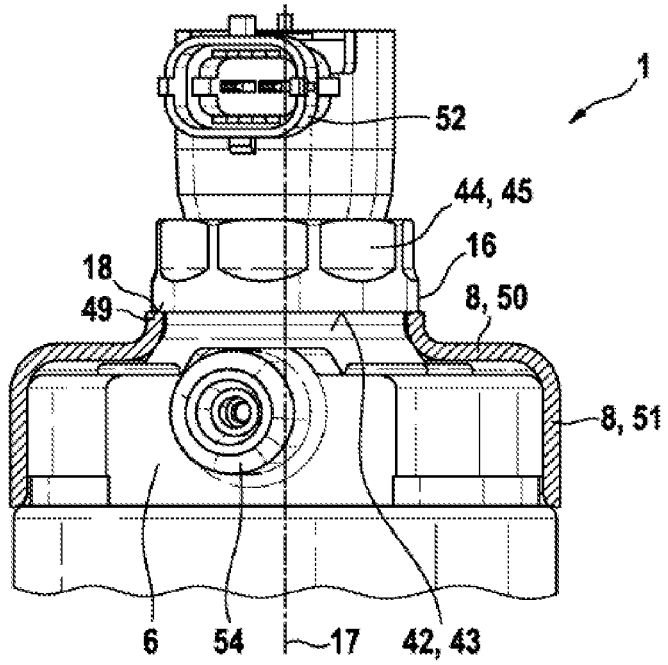
FIG. 10 shows a second side view of the part of the high pressure pump after the fastening of the covering cap in accordance with FIG. 5 to the cylinder, and the longitudinal section of the covering cap.

The covering cap 8 has an edge 49 at the opening 48. Before the mounting or fastening of the covering cap 8 to the high pressure pump 1, the electric plug 52 has already been finally fastened to the cylinder 6. In order to mount the covering cap 8, the electric plug 52 is first of all introduced into the opening 48 of the covering cap 8 (FIG. 7), and the covering cap 8 is subsequently placed in the region of the opening 48 or in the region of the edge 49 onto an upper end of the union nut 45. Here, the diameter of the opening 48 is slightly smaller than the external diameter of the union nut 45 on the upper end region of the union nut 45 in accordance with the illustration in FIG. 6. In FIG. 8, the covering cap 8 is placed in the region of the opening 48 on said upper end region of the union nut 45. Subsequently, a force is applied in the axial direction to the covering cap 8 at the edge 49 by way of a tool 56, with the result that the edge 49 is stretched radially to the outside in the region of the opening 48 on account of the geometry of the union nut 45 on the upper end region, with the result that the diameter of the opening 48 of the covering cap 8 is increased as a result and corresponds substantially to the diameter of the union nut 45. On account of said elastic radial stretching of the covering cap 8 at the edge 49, the edge 49 of the covering cap 8 is therefore prestressed elastically. Furthermore, in accordance with the illustration in FIGS. 6, 9 and 10, the covering cap 8 is moved in a downward direction by the tool 56 in the direction of the fuel nozzle 54, until the edge 49 of the covering cap 8 has swept over the union nut 45, with the result that an elastic recovery of the covering cap 8 occurs at the edge 49 as a result, and, as a result, the diameter of the opening 48 of the covering cap 8 is reduced again on account of the elastic recovery in the radial direction 41. In FIGS. 6 and 10, the covering cap 8 has already been fastened to the high pressure pump 1, with the result that the edge 49 lies on the axial stop 43 of the union nut 45 on account of the elastic recovery of the edge 49 of the covering cap 8. As a result, the covering cap 8 is reliably fastened to the remaining high pressure pump 1 in a positively locking manner. Here, the geometry of the axial supporting section 51 can also be configured in such a way that the axial supporting section 51 also optionally additionally lies on the cylinder 6 with an elastic prestress after the fastening in the position in FIGS. 6 and 10. As a result, the covering cap 8 is additionally optionally fastened to the remaining high pressure pump 1 in a non-positive manner.

Figure 11:
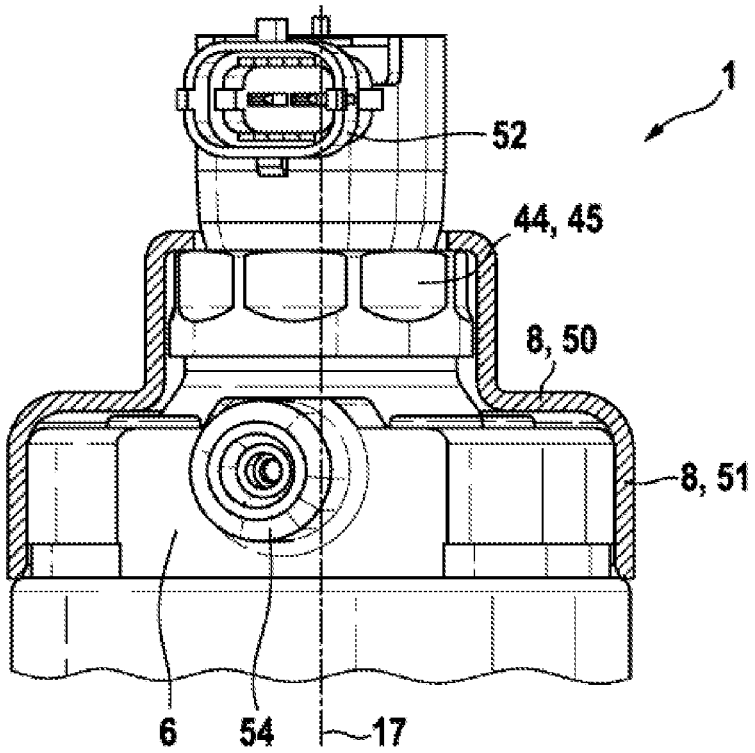
FIG. 11 shows a second side view of the part of the high pressure pump after the fastening of the covering cap in a second exemplary embodiment to the cylinder, and the longitudinal section of the covering cap.

FIG. 11 shows a further, second exemplary embodiment of the fastened covering cap 8. The covering cap 8 also covers the union nut 45.

Figure 3:
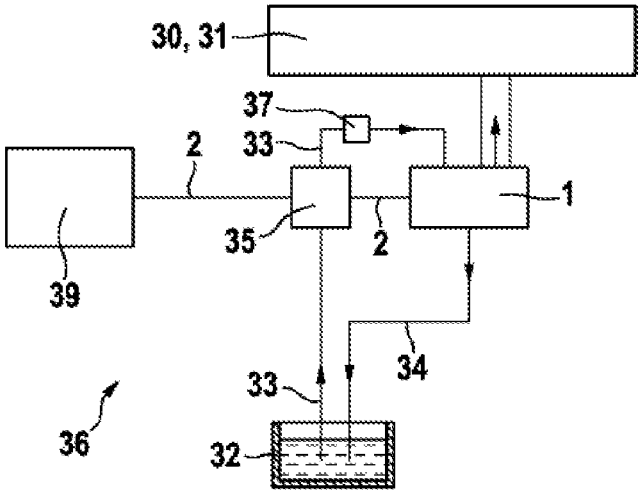
FIG. 3 shows a greatly diagrammatic view of a high pressure injection system.
Figure 4:
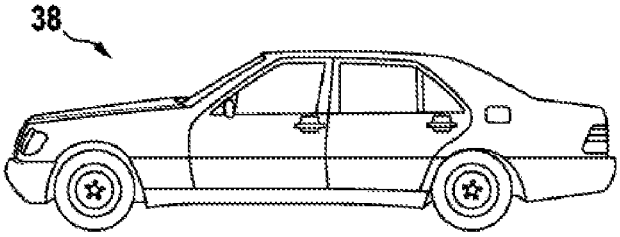
FIG. 4 shows a view of a motor vehicle.
Figure 5:
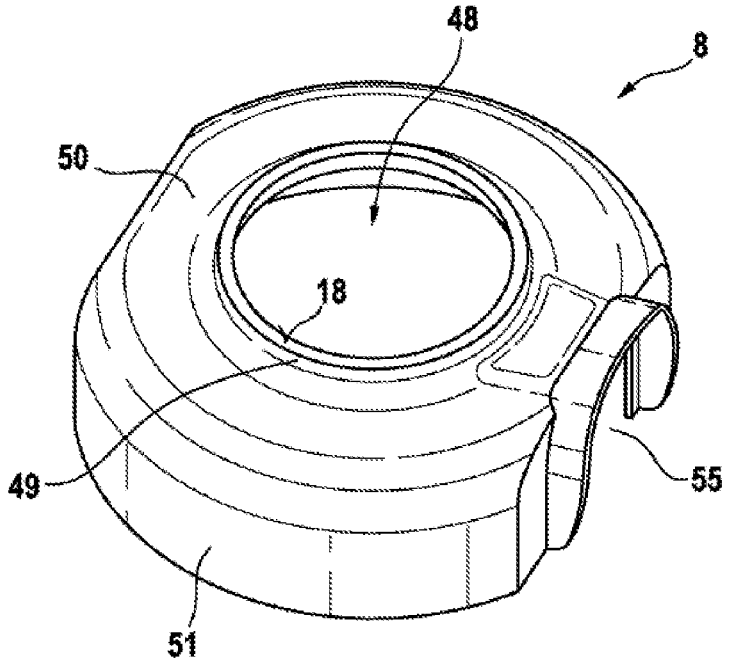
FIG. 5 shows a perspective view of a covering cap in a first exemplary embodiment for a cylinder of the high pressure pump.

FIG. 3 depicts a greatly diagrammatic illustration of the high pressure injection system 36 for a motor vehicle 38 with a high pressure rail 30 or a fuel distributor pipe 31. From the high pressure rail 30, the fuel is injected by means of valves (not shown) into the combustion chamber of the internal combustion engine 39. A prefeed pump 35 delivers fuel from a fuel tank 32 through a fuel line 33 to the high pressure pump 1 in accordance with the above exemplary embodiment. The prefeed pump 35 can also be driven by way of an electric motor (not shown) without a mechanical coupling (not shown) to the drive shaft 2. Here, the high pressure pump 1 and the prefeed pump 35 are driven by the drive shaft 2. The drive shaft 2 is coupled to a crankshaft of the internal combustion engine 39. As has already been described, the high pressure rail 30 serves to inject the fuel into the combustion chamber of the internal combustion engine 39. The fuel which is delivered by the prefeed pump 35 is guided through the fuel line 33 to the high pressure pump 1. Here, the fuel which is not required by the high pressure pump 1 is guided back into the fuel tank 32 again through a fuel return line 34. A metering unit 37 controls and/or regulates the quantity of fuel which is fed to the high pressure pump 1, with the result that the fuel return line 34 can be dispensed with in a further refinement (not shown).

Viewed overall, considerable advantages are associated with the high pressure pump 1 according to the invention and the high pressure injection system 36 according to the invention. The covering cap 8 is configured from an elastic plastic. As a result, the covering cap 8 can be adapted advantageously to different geometries, in particular even during the mounting. This makes the mounting of the covering cap 8 possible after the fastening of the electric plug 52 to the high pressure pump 1, since an elastic deformation of the covering cap 8 is necessary during guiding of the electric plug 52 through the opening 48 of the covering cap 8 on account of the geometry of the high pressure pump 1 including the electric plug 52. On account of said elastic properties of the covering cap 8, said covering cap 8 can also make a sealing function possible with regard to the cylinder 6, in particular in the case of an additional optional prestress of the covering cap 8 after the fastening, with the result that the covering cap 8 lies on the remaining high pressure pump 1 under an elastic prestress at least on part faces between the covering 8 and the remaining high pressure pump 1, and this makes a sealing function possible as a result. As a result, a penetration of moisture and water into the region between the covering cap 8 and the remaining high pressure pump 1 can advantageously be avoided.

The invention claimed is:

1. A high pressure pump (1) for delivering a fluid, the high pressure pump comprising a drive shaft (2) with at least one cam (3), at least one piston (5), at least one cylinder (6) in which the at least one piston (5) is mounted, the at least one piston (5) being supported on the drive shaft (2) with the at least one cam (3), with the result that a translational movement can be carried out by the at least one piston (5) on the basis of a rotational movement of the drive shaft (2), and at least one covering cap (8) which is fastened indirectly to the cylinder (6) on an outer side, wherein an end (18) of the at least one covering cap (8) lies on a projection (16) of the high pressure pump (1) in order to fasten the end (18) of the covering cap (8) to the projection (16) in a positively and non-positively locking manner, and wherein the at least one covering cap (8) lies on the high pressure pump (1) with an elastic prestressing force.

2. The high pressure pump as claimed in claim 1, characterized in that the projection (16) is configured on the high pressure pump (1) on the outer side and/or the projection (16) is configured as an undercut (42) and/or the projection (16) is configured in the radial direction (41) with regard to a longitudinal axis (17) of the cylinder (6), and the end (18) of the at least one covering cap (8) lies on an axial stop (43) of the projection (16).

3. The high pressure pump as claimed in claim 1, characterized in that the projection (16) is configured in the circumferential direction or tangential direction with regard to a longitudinal axis (17) of the cylinder (6) and/or the projection (16) is formed by a ring (44) or a nut (45) on the cylinder (6).

4. The high pressure pump as claimed in claim 1, characterized in that the at least one covering cap (8) has a substantially central opening (48).

5. The high pressure pump as claimed in claim 4, characterized in that the at least one covering cap (8) has a substantially radially configured supporting section (50) and a substantially axially configured supporting section (51).

6. The high pressure pump as claimed in claim 5, characterized in that the opening (48) is configured on the supporting section (50).

7. The high pressure pump as claimed in claim 4, characterized in that the end (18) of the at least one covering cap (8) which lies on the projection (16) of the remaining high pressure pump (1) is an edge (49) of the opening (48).

8. The high pressure pump as claimed in claim 4, characterized in that an electric plug (52) is arranged in the opening (48).

9. The high pressure pump as claimed in claim 1, characterized in that a cutout (55) for a fuel nozzle (54) is configured on the at least one covering cap (8), and/or the cylinder (6) comprises a cylinder head (14) and/or a mounting cylinder (15).

10. The high pressure pump as claimed in claim 1, characterized in that the at least one covering cap (8) is configured at least partially from an elastic plastic, and/or the at least one covering cap (8) is configured at least partially from a material with a modulus of elasticity of less than 5, 1, or 0.2 $kN/mm^2$.

11. A method for producing a high pressure pump (1) as claimed in claim 1, the method comprising the steps:

provision of a drive shaft (2) with at least one cam (3), provision of at least one piston (5), provision of at least one cylinder (6) in which the at least one piston (5) is mounted, provision of at least one covering cap (8), assembling of the at least one drive shaft (2), the at least one piston (5) and the at least one cylinder (6), with the result that the at least one piston (5) is supported on the drive shaft (2) with the at least one cam (3), and a translational movement can be carried out by the at least one piston (5) on the basis of a rotational movement of the drive shaft (2), and fastening of the at least one covering cap (8) indirectly on the cylinder (6) on the outer side, characterized in that the covering cap (8) is first of all stretched elastically for fastening purposes, and an elastic recovery is subsequently carried out, with the result that an end (18) of the at least one covering cap (8) lies on the projection (16) of the remaining high pressure pump (1) on account of the elastic recovery, and the at least one covering cap (8) is fastened to the projection (16) in a positively and non-positively locking manner as a result.

12. The method as claimed in claim 11, characterized in that first of all an electric plug (52) is mounted, and subsequently the at least one covering cap (8) is fastened, and/or the at least one covering cap (8) is stretched in the radial direction (41) with regard to the longitudinal axis (17) of the cylinder (6) and is recovered elastically.

13. The method as claimed in claim 11, characterized in that the at least one covering cap (8) is stretched substantially at an edge (49) of an opening (48) as the end (18) of the at least one covering cap (8), with the result that the size of the opening (48) is increased by way of the stretching, and the elastic recovery is subsequently carried out substantially at the edge (49) of the opening (48), and/or the electric plug (52) which has already been mounted is first of all guided through the opening (48) of the at least one covering cap (8), and the elastic stretching of the at least one covering cap (8) is subsequently carried out, and/or the covering cap (8) is stretched, and the covering cap (8) is subsequently fastened on the remaining high pressure pump (1) with an elastic prestress.

14. The method as claimed in claim 11, characterized in that the at least one covering cap (8) is stretched, by the covering cap (8) being pushed onto the high pressure pump (1) on the outer side in the axial direction (40), and the axial movement of the at least one covering cap (8) bringing about stretching of the at least one covering (8) on account of the outer-side geometry of the high pressure pump (1).

15. A high pressure injection system (36) for an internal combustion engine (39), the high pressure injection system comprising a high pressure pump (1) as claimed in claim 1, and a high pressure rail (30) communicating with the high pressure pump.

16. The high pressure injection system as claimed in claim 15, further comprising a prefeed pump for delivering a fuel from a fuel tank to the high pressure pump.

17. The high pressure pump as claimed in claim 1, characterized in that the projection (16) is configured in the circumferential direction or tangential direction with regard to a longitudinal axis (17) of the cylinder (6) and/or the projection (16) is formed by a ring (44) or a union nut (45) on the cylinder (6).

18. The high pressure pump as claimed in claim 1, characterized in that the at least one covering cap (8) lies on the high pressure pump (1) with an elastic prestressing force and/or the at least one covering cap (8) is configured completely from a thermoplastic elastomer, and/or the at least one covering cap (8) is configured completely from a material with a modulus of elasticity of less than 5, 1, or 0.2 $kN/mm^2$.

19. The method as claimed in claim 11, characterized in that the at least one covering cap (8) is stretched substantially at an edge (49) of an opening (48) as the end (18) of the at least one covering cap (8), with the result that the size of the opening (48) is increased by way of the stretching, and the elastic recovery is subsequently carried out substantially at the edge (49) of the opening (48), and/or the electric plug (52) which has already been mounted is first of all guided through the opening (48) of the at least one covering cap (8), and the elastic stretching of the at least one covering cap (8) is subsequently carried out, and/or an axial supporting section (51) of the covering cap is stretched in the radial direction (41), and the axial supporting section (51) is subsequently fastened on the remaining high pressure pump (1) with an elastic prestress.

20. The method as claimed in claim 11, characterized in that the at least one covering cap (8) is stretched, by the covering cap (8) being pushed onto the high pressure pump (1) on the outer side in the axial direction (40), and the axial movement of the at least one covering cap (8) bringing about radial stretching of the at least one covering (8) on account of the outer-side geometry of the high pressure pump (1).

* * * * *